United States Patent [19]

Carlstedt

[11] Patent Number: 5,040,432

[45] Date of Patent: Aug. 20, 1991

[54] CONTROL HANDLE EXTENSION

[76] Inventor: Paul A. Carlstedt, 12545 Third Ave. NW., Seattle, Wash. 98177

[21] Appl. No.: 458,341

[22] Filed: Dec. 28, 1989

[51] Int. Cl.[5] ..... G05G 1/00

[52] U.S. Cl. ..... 74/544; 74/480 B

[58] Field of Search ..... 74/544, 480 B, 523, 74/543

[56] References Cited

U.S. PATENT DOCUMENTS

| | | | |
|---|---|---|---|
| 1,450,113 | 3/1923 | Pratt | 74/544 X |
| 2,600,852 | 6/1952 | Coots | 74/480 B |
| 2,610,084 | 9/1952 | Anderson | 74/544 X |
| 2,679,766 | 6/1954 | Jacobsen et al. | 74/480 B X |
| 2,826,088 | 3/1958 | Wittick | 74/544 X |
| 2,901,918 | 9/1959 | Beamer | 74/480 B |
| 2,903,903 | 9/1959 | Jaromy | 74/471 |
| 2,926,544 | 3/1960 | Carmichael | 74/480 B |
| 3,174,357 | 3/1965 | Conklin | 74/480 |
| 3,371,641 | 3/1968 | Rohman | 74/480 B |
| 3,456,525 | 7/1969 | Oldham | 74/544 |
| 3,955,438 | 5/1976 | Zakrzewski | 74/480 B |
| 4,480,571 | 11/1984 | Meyer | 114/146 |
| 4,624,206 | 11/1986 | Frye et al. | 114/146 |
| 4,681,056 | 7/1987 | Friedle et al. | 114/146 |

OTHER PUBLICATIONS

Troll-Master® brochure, copyright 1987 by Troll-Master, Inc. of Sandpoint, Idaho.

*Primary Examiner*—Rodney M. Lindsey

[57] ABSTRACT

An improved and simpler control handle extension for attaching to the tiller control handle of marine-type outboard motors. The device, while constructed of only two basic structural members, is still adapted to be adjustable in effective operating length. The device can be quickly and easily attached to virtually all sizes of tiller handles without restricting access to the "kill-button" usually located at the outer end of the motor's tiller handle.

6 Claims, 1 Drawing Sheet

CONTROL HANDLE EXTENSION

FIELD OF THE INVENTION

The present invention relates to a control handle extension for attaching to the short tiller control handles normally provided on marine-type outboard motors.

DESCRIPTION OF PRIOR ART

The typical marine-type of outboard motor is equipped with a relatively short tiller control handle to steer the boat and in some cases control the motor throttle. It is often desirable for an operator to be seated somewhat more forward in the boat to achieve better balance to buoyancy or planing over the water. This often places the operator out of easy reach of the tiller control handle.

Many types of extension handles have been proposed in an effort to overcome this situation. Almost invariably the prior devices have utilized a short sleeve to completely encircle the tiller control handle. However the tiller handles of various outboard motors come in many different sizes and shapes and it is not easy to accommodate all of them in this manner. Some existing sleeves even use shims to adapt to various sizes of tiller handles. Another disadvantage is using extension handles which have sleeve-like attachments encircling the tiller handle is that these sleeves usually surround and conceal the "kill-buttons" located on the extreme outer end of the tiller handle. (This button is normally used to shut the motor off.)

The diameters of the sleeve portion of prior control handle extension devices are, of course, quite large in order to accommodate the larger tiller control handles encountered. Thus it has been common practice to step down the diameter by attaching a much smaller tube to serve as the remaining portion of the handle extension. If the remaining portion must also be adjustable in length, a total of two tube sections (usually telescopic) are required—plus the smaller hardware parts used for connection and adjustment.

At best, the cost of most existing control handle extensions has been rather high and this has severely limited the potential market. In view of these problems this present invention has certain objectives.

STATEMENT OF THE OBJECTIVES OF INVENTION

A principle objective of the present invention is to present a simplified control handle extension for the tiller control handle of an outboard motor while at the same time keeping the motor's "kill" button fully exposed and accessible.

Still another objective of the present invention is to provide a control handle extension having an arm member which is easily adjusted in effective operating length and which can be manufactured at low cost.

These and other objectives of this invention will become more apparent from the description which follows:

SUMMARY OF THE INVENTION

This invention is an improved type of control handle extension for outboard motors which will be substantially less costly to manufacture because it can be made using only two simple basic structural members and which is easily and quickly attached to all sizes and shapes of tiller control handles while at the same time being adjustable in effective operating length.

DETAILED DESCRIPTION

Figure 1:
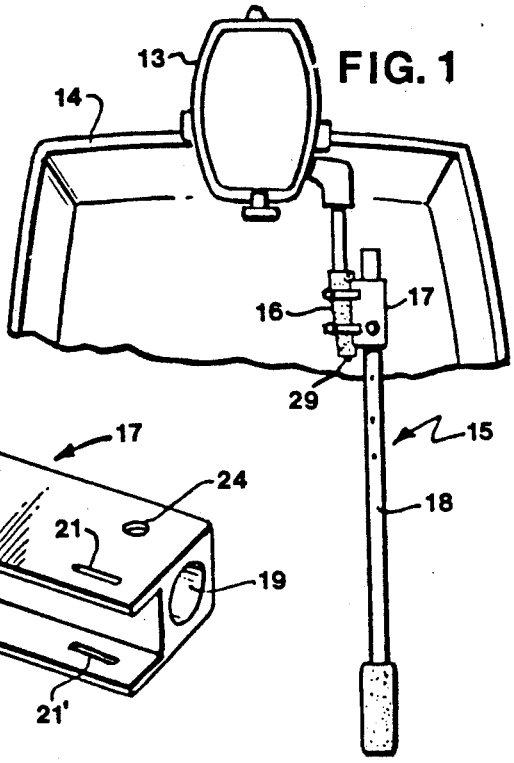
FIG. 1 is a top plan view of an embodiment of the present invention shown attached to the tiller control handle of a marine-type outboard motor.
Figure 4:
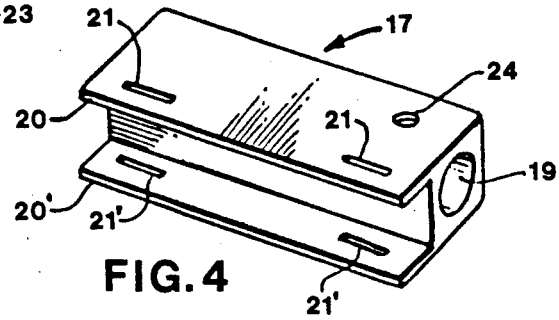
FIG. 4 is a perspective view of a slightly elongated support member body which comprises one of the two basic structural members of the present invention.
Figure 3:
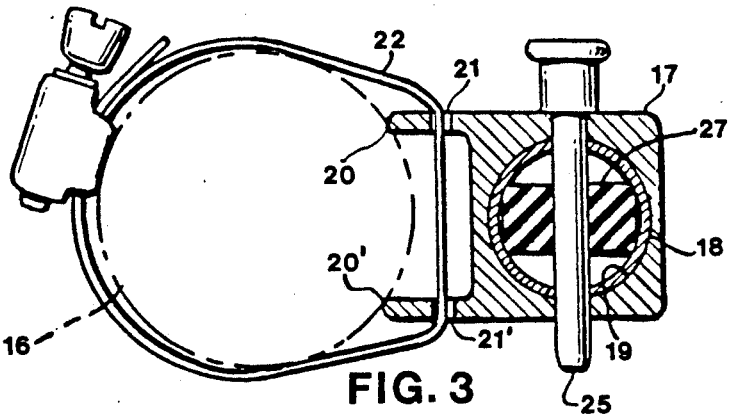
FIG. 3 is an enlarged transverse vertical section along the line 3—3 of FIG. 2.

With reference to FIG. 1 an outboard motor 13 is mounted on the stern 14 of a boat. A control handle extension 15 is shown attached to the tiller control handle 16 at one side thereof.

The two basic structural members of the present invention consist, firstly, of a slightly elongated support member body 17 and, secondly, a longer tubular arm member 18 which is supported by the support member body 17. As shown herein the arm member 18 is inserted and supported within a longitudinal bore 19 of the support member 17 is clearly shown in the various Figures.

The support member body 17 is also provided with two relatively narrow spaced-apart flanges, namely, a first flange 20 and a second flange 20$^1$ which extend along the length of the body 17 and parallel to the bore 19. The flanges 20 and 20$^1$ are provided with two slot-like apertures (such as at 21 and 21' respectively) along the lengths thereof in mating relationship with each other to define a pair of transverse passageways between the two flanges for threading the strap portions of two worm-type clamps 22 which when used to encircle the tiller control handle 16 operate to bind the flanges 20 and 20$^1$ of the support member body 17 firmly against the tiller control handle 16.

The bore 19 of the support member body 17 is sized to provide a sliding fit with the tubular arm member 18. The arm member 18 is provided with a series of transverse holes, such as 23, along a portion of its inner length, and which penetrate both walls of the tube 18, for selective mating with a similar hole 24 which also penetrates both walls of the support member body 17. By inserting a headed locking pin (such as 25) through any set of aligned holes of the two respective members, 17 and 18, the effective operating length of the control handle extension 15 is thereby established. Also the pin 25 will likewise transmit torque from the arm member 18 into the support member 17 and into the tiller control handles 16 to affect possible throttle control of the motor 13.

Figure 2:
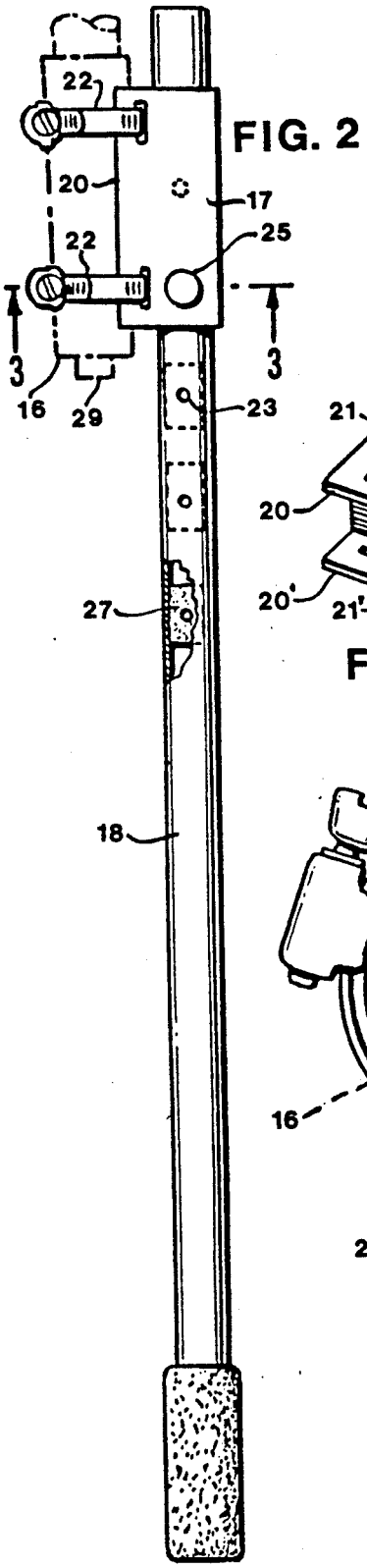
FIG. 2 is an enlarged view of a portion of FIG. 1 to show the control handle extension in greater detail.
Figure 5:
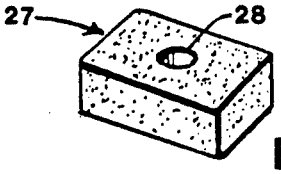
FIG. 5 is a perspective view of one of the several small special elastomeric inserts which may be used in the present invention.

When the motor 13 is operating a certain amount of vibration is likely to be present in the tiller control handle 16 and anything attached to it. Therefore a means of making the locking pin 25 resist to vibration is provided by a set elastomeric block-like inserts 27 (see FIG. 5) located within the inside diameter of the arm member 18 at the location of each hole 23. (See FIG. 2) Each insert 27 is sized to provide an interference fit with the inside diameter of the arm member 18 to retain it in proper location. The diameter of the central holes 28 in the inserts 27 is slightly less than the diameter of the pin 25 to thus grip and retain the pin against the effects of vibration.

The block-like elastomeric insert 27 discussed above could be formed in other shapes such as tubular or as a solid round core-like plug. However, such shapes are difficult to inset into the tube with accuracy whereas a block-shaped insert is easily inserted and rotated into position using a forked insertion tool.

From the above description it is apparent that the subject invention meets its objectives. It provides a simplified control handle extension for easy and rapid attachment to any common size of tiller control handle and leaves the "kill-button" (such as at 29) completely open and accessible.

Other vibrations and embodiments of the present invention are contemplated. Those skilled in the art will readily appreciate such variations upon reviewing the above disclosure. Therefore the scope of the present invention is not to be limited by the above description but is limited only by the following claims.

What is claimed is:

1. A control handle extension for use with a boat and a marine type outboard motor having a tiller control handle comprising:

an elongated support member body having a pair of relatively narrow spaced-apart flanges having their planes parallelly disposed to each other and extending along the length of said support member body at one side thereof;

a pair of slot-like apertures in a first of said flanges and a pair of slot-like apertures in the second of said flanges, said pairs of apertures being disposed in side-by-side alignment with each other to define a pair of transverse passageways running across from said first flange to said second flange for threading a strap-like clamp through each of said passageways;

a pair of strap-like clamps for threading through said pair of transverse passageways and for encircling said tiller control handle to attach said support member body upon said tiller control handle at one side thereof; and an extension arm member attached in longitudinal alignment with said support member body.

2. A control handle extension for use with a boat and a marine type outboard motor having a tiller control handle comprising:

en elongated support member body having a pair of relatively narrow and spaced apart flanges extending along the length of said support member body at one side thereof;

a pair of mating and aligned slot-like apertures in each of said flanges and located near the ends of said flanges for defining a passageway at each end of said support member body for threading a pair of strap-like clamps therethrough;

a pair of strap-like clamps for threading through said pair of passageways and for encircling said tiller control handle to attach said support member body upon said till control handle at one side thereof; and an elongated extension arm member attached in longitudinal alignment with said support member body.

3. A control handle extension for use with a boat and a marine type outboard motor having a tiller control handle comprising:

an elongated support member body having a longitudinal bore throughout its length and having a pair of relatively narrow spaced apart flanges, the planes of said flanges being spaced apart but generally parallel to each other at one side of said body and extending outwardly away from said bore and aligned parallel to said bore;

a pair of mating and aligned slot-like apertures in each of said flanges and located near the ends of said flanges for defining a passageway at each end of said support member body for threading a pair of strap-like clamps therethrough;

a pair of strap-like clamps for threading through said pair of passageways and for encircling said tiller control handle to attach said support member body upon said tiller control handle at one side thereof;

an elongated tubular extension arm member attached in longitudinal alignment with said support member body; and a means of locking said extension arm member to said support member body.

4. A control handle extension for use with a boat and a marine type outboard motor having a tiller control handle comprising:

an elongated support member body having a longitudinal bore throughout is length and having a pair of relatively narrow spaced apart flanges, the planes of said flanges being spaced apart but generally parallel to each other at one side of said body and extending outwardly away from said bore and aligned parallel to said bore;

a pair of mating and aligned slot-like apertures in each of said flanges and located near the ends of said flanges for defining a passageway at each end of said support member body for threading a pair of strap-like clamps therethrough;

a pair of strap-like clamps for threading through said pair of passageways and for encircling said tiller control handle to attach said support member body upon said tiller control handle at one side thereof;

an elongated tubular extension arm member attached in longitudinal alignment with said support member body;

a locking pin for inserting through mating cross holes in said support member body and said extension arm member; and an elastomeric insert for positioning within the inside diameter of said extension arm member and having a centrally located hole for alignment with one of said cross holes in said arm member, said insert having an interference fit with the inside diameter of said extension arm member and the outside diameter of said locking pin which passes through said hole in said insert.

5. A control handle extension for use with a boat and a marine-type outboard motor have a tiller control handle comprising the following:

a support member body having a longitudinal bore and a pair of spaced-apart flanges projecting laterally at one side of said body;

a tubular arm member for mounting within said bore of said support member body;

a means of attaching said support member body to said tiller control handle in an off-center position relative to said tiller control handle;

a locking pin for inserting simultaneously through mated and aligned holes in said support member body and said tubular arm member; and an elastomeric insert mounted internally within said tubular arm member to provide frictional interference with said locking pin as it penetrates through said aligned holes in said tubular arm member.

6. A control handle extension for use with a boat and a marine-type outboard motor having a tiller control handle comprising:

a substantially straight elongated control handle extension having a body for positioning adjacent to said tiller control handle in an off-center position relative to said tiller control handle;

a pair of laterally disposed spaced-apart flanges projecting from a side of said control handle extension body for bearing against said tiller control handle;

a set of mating and aligned slots in the pair of said flanges; and a pair of clamps to be selectively inserted through said slots in said flanges for securing said control handle extension to said tiller control handle.

* * * * *